US010697171B2

(12) United States Patent
Melo Pereira et al.

(10) Patent No.: US 10,697,171 B2
(45) Date of Patent: Jun. 30, 2020

(54) CONSTRUCTION MODULAR SYSTEM BASED ON SHEET MOLDING COMPOUND (SMC) PANELS

(71) Applicant: MMIGG—NOVOS NEGOCIOS E REPRESENTACOES LTDA—ME, Vitoria (BR)

(72) Inventors: Hercik Melo Pereira, Vitoria (BR); Marcelo Mignoni De Melo, Vitoria (BR)

(73) Assignee: MMIGG-NOVOS NEGOCIOS E REPRESENTACOES LTDA-ME, Vioria (BR)

( * ) Notice: Subject to any disclaimer, the term of this patent is extended or adjusted under 35 U.S.C. 154(b) by 0 days.

(21) Appl. No.: 16/070,599

(22) PCT Filed: Apr. 9, 2016

(86) PCT No.: PCT/BR2016/050078
§ 371 (c)(1),
(2) Date: Oct. 26, 2018

(87) PCT Pub. No.: WO2017/173513
PCT Pub. Date: Oct. 12, 2017

(65) Prior Publication Data

US 2019/0055728 A1 Feb. 21, 2019

(51) Int. Cl.
*E04B 1/02* (2006.01)
*E04C 2/292* (2006.01)
(Continued)

(52) U.S. Cl.
CPC ..... *E04B 1/02* (2013.01); *E04B 1/34321* (2013.01); *E04C 2/22* (2013.01); *E04C 2/292* (2013.01); *E04C 2/384* (2013.01)

(58) Field of Classification Search
CPC ..... E04B 1/02; E04B 1/34321; E04C 2/22; E04C 2/292; E04C 2/384
See application file for complete search history.

(56) References Cited

U.S. PATENT DOCUMENTS 2,240,487 A * 5/1941 Benham ..... E04C 2/292 52/792.1
2,482,918 A * 9/1949 Kump, Jr. ..... E04B 1/10 52/64

(Continued)

FOREIGN PATENT DOCUMENTS

BR 1000968 6/2013
CN 202090470 12/2011

(Continued)

OTHER PUBLICATIONS

PCT International Searching Authority; PCT International Search Report dated Jun. 6, 2016; entire document.

*Primary Examiner* — James M Ference
(74) *Attorney, Agent, or Firm* — Allen Dyer Doppelt & Gilchrist PA

(57) ABSTRACT

A modular construction system based on SMC panels belonging to the field of engineering—more specifically to the field of infrastructure construction—has the technical feature of being composed of main modular panels made of a sheet molding compound (SMC), having a general rectangular shape, produced in predefined sizes and provided with swiveled enclosing borders provided with uniformly distributed through holes for interconnecting the panels in a hermetically sealed and easy manner by means of screws, nuts and seals. The sets of panels are in turn interconnected by corner bead panels and by a screw and seal system between perpendicular panels that leads to the formation of building structures.

1 Claim, 4 Drawing Sheets

(51) Int. Cl.

| | |
|---|---|
| ***E04C 2/38*** | (2006.01) |
| ***E04C 2/22*** | (2006.01) |
| ***E04B 1/343*** | (2006.01) |

(56) References Cited

U.S. PATENT DOCUMENTS 2,912,725 A * 11/1959 Ries ..... E04C 2/292 52/592.1
2,915,791 A * 12/1959 Hauf ..... E04B 1/8218 52/214
2,927,665 A * 3/1960 Hauf ..... E04B 1/6803 52/262
2,947,436 A * 8/1960 Kappen ..... F25D 23/063 220/1.5
3,195,425 A * 7/1965 Taggart ..... B65D 5/56 493/95
3,525,465 A * 8/1970 Hotz ..... B65D 5/0245 206/526
3,564,801 A * 2/1971 Huerta ..... E04B 1/54 52/580
3,771,277 A * 11/1973 Rausch ..... E04B 1/6179 52/468
3,807,104 A * 4/1974 Webster ..... E04B 1/3445 135/117
3,854,260 A * 12/1974 O'Hanlon ..... E04B 1/6175 52/259
3,942,290 A * 3/1976 O'Sheeran ..... E04B 1/6137 52/57
4,409,271 A * 10/1983 Pehr ..... E04C 2/296 428/71
4,616,452 A * 10/1986 Lemerre ..... E04B 1/14 52/302.3
5,199,478 A * 4/1993 Kubota ..... E06B 3/481 160/229.1
5,319,904 A * 6/1994 Pascoe ..... E04H 1/1205 52/584.1
5,497,589 A * 3/1996 Porter ..... E04C 2/296 52/309.2
5,678,369 A * 10/1997 Ishikawa ..... B32B 3/02 52/309.7
5,875,599 A * 3/1999 McGrath ..... E04B 1/803 52/586.2
6,415,557 B1 * 7/2002 McCalley ..... E04B 1/08 52/79.1
8,429,858 B1 * 4/2013 Robinson ..... E04H 1/005 52/79.5
8,528,288 B1 * 9/2013 Kinser, Jr. ..... E04B 1/6183 292/194
9,353,487 B1 * 5/2016 Szekely ..... E01C 15/00
2004/0140739 A1 * 7/2004 Saravis ..... A47B 47/0033 312/111
2004/0145283 A1 * 7/2004 Saravis ..... A47B 47/0033 312/111
2004/0155562 A1 * 8/2004 Saravis ..... A47B 47/0033 312/111
2004/0178704 A1 * 9/2004 Saravis ..... A47B 47/0033 312/111
2005/0104483 A1 * 5/2005 Saravis ..... A47B 47/0033 312/111
2008/0271402 A1 * 11/2008 Gingras ..... E04B 1/34321 52/506.02
2009/0056257 A1 * 3/2009 Mollinger ..... B29C 37/0032 52/314
2013/0025213 A1 * 1/2013 Cetindag ..... E04B 2/18 52/16
2014/0013663 A1 * 1/2014 Shein ..... A01G 9/02 47/66.1
2014/0305050 A1 * 10/2014 Schulze ..... H02S 20/23 52/173.3
2014/0318037 A1 * 10/2014 Aldino ..... E04B 7/163 52/90.1
2014/0335314 A1 * 11/2014 Aldino ..... F16L 59/065 428/159
2015/0027514 A1 * 1/2015 Furutani ..... E04C 2/324 136/251
2016/0340925 A1 * 11/2016 Jimenez ..... E04H 15/20
2019/0055728 A1 * 2/2019 Melo Pereira ..... E04C 2/22

FOREIGN PATENT DOCUMENTS

CN 202248363 5/2012
CN 103978614 8/2014

* cited by examiner

CONSTRUCTION MODULAR SYSTEM BASED ON SHEET MOLDING COMPOUND (SMC) PANELS

CROSS REFERENCE TO RELATED APPLICATION

This application is the § 371 National Stage Entry of International Application No. PCT/BR2016/050078, filed on Apr. 9, 2016, the contents of which are herein incorporated by reference in their entirety.

FIELD OF THE INVENTION

The present invention relates to the technical sector of engineering, specifically infrastructure construction using modular "main" panels of the SMC (Sheet Molding Compound) type.

BACKGROUND OF THE INVENTION

Nowadays, in many countries, there are people developing technology based on SMC modules, boards and profiles. Their main objective is to transfer, to the final product (the constructed module), the intrinsic capacities of the mentioned composite to a great range of uses, not only housing, as can be observed in the document WO2011123914A1 ("MODULAR WATER TANK MOUNTED WITH SMC PLATES"—D.P. Oct. 13, 2011). This document refers to a reservoir for water and other similar fluids, which has the distinct characteristic of being built with SMC boards. These boards, if properly bolted to each other, through their perimeters, create a specific shape of a reservoir of great capacity for fluid storage. This creates a modular reservoir that can be assembled in hard to reach places. One can conclude that this project was carried out especially for the construction of tanks with snap-fit cutouts and adhesive tape at the joining of the edges.

Likewise, we mention the American document U.S. Pat. No. 5,875,599 (A)—("MODULAR INSULATION PANELS AND INSULATED STRUCTURES"—IPC: E0461/80—D.P: Mar. 3, 1999), which refer to the improvement of thermal insulation panels, a modular system that includes the use of SMC boards for the development of specific isothermal modular chambers.

Finally, we mention the original document GB2491415 ("A MODULAR BUILDING"—IPC: E0461/00—D.P: Dec. 5, 2012), which, in the state of the art, is the only SMC construction system dedicated to the construction of housing modules. The present utility model has the purpose of facing the practical limitations of the original model.

SUMMARY OF THE INVENTION

Taking into consideration the foregoing, the present invention aims at introducing new mechanisms, along with existing solutions, in order to provide a final product that favor project flexibility, fast and practical system assembly and disassembly, without affecting the physical integrity, safety and quality of the constructive system delivered to the client.

It refers to innovative techniques applied to the existing construction systems, since it uses "main" panels produced modular type SMC (Sheet Molding Compound) and "angled" panels. It offers greater construction freedom in the development (assembly and disassembly) of varied construction projects, such as building sites, warehousing, and locker rooms, among others. The flexibility of the panels allows the clients to determine the desired dimensions and layout according to the needs of their projects.

Stemming from the earlier application WO2012164311A1 ("A MODULAR BUILDING"—IPC: E0461/00—D.P: Dec. 5, 2012), which refers to a module of SMC construction, to be built in varied sizes, with a double ramp roof on the cross-section profile, with the objecting of building triangular or pivoted housing structures. The present application, however, includes application and form innovations that result in functional improvements, which will be explained below, justifying this request for protection.

The present invention addresses a need related to existing construction systems, namely, the need for greater flexibility in the projects. This innovation eliminates typical limitations of pre-fabricated systems. Since it is based on only 2 types of basic panels, builders can easily customize their projects according to their needs. In addition, it has a fast, practical and sustainable assembly and disassembly process, considering the fact that there is no need for water use, it does not produce residue and it is possible to reuse that structures used the in the development of new construction projects. These characteristics result in a greater range of the system's application and allow for module reuse, which, when added to the technical capabilities inherent to the SMC compound, elevates the competitiveness of this construction system in relation to traditional methods of civil construction.

The earlier application WO2012164311A1, in spite of including SMC construction modules, containing thermal-acoustical and fireproof isolation, had the practical limitation of only being applicable to triangular structural project, based on cross-sectional roofs, which are less common in "fast" or "transitory" construction, such as building sites, locker rooms, offices, etc. The present invention helps address this practical need.

BRIEF DESCRIPTION OF THE DRAWINGS

The present invention, the practical improvements in usage and its advantages will be better understood if the description and illustrations are analyzed together with the following sketches.

DETAILED DESCRIPTION OF PREFERRED EMBODIMENTS

Figure 1:
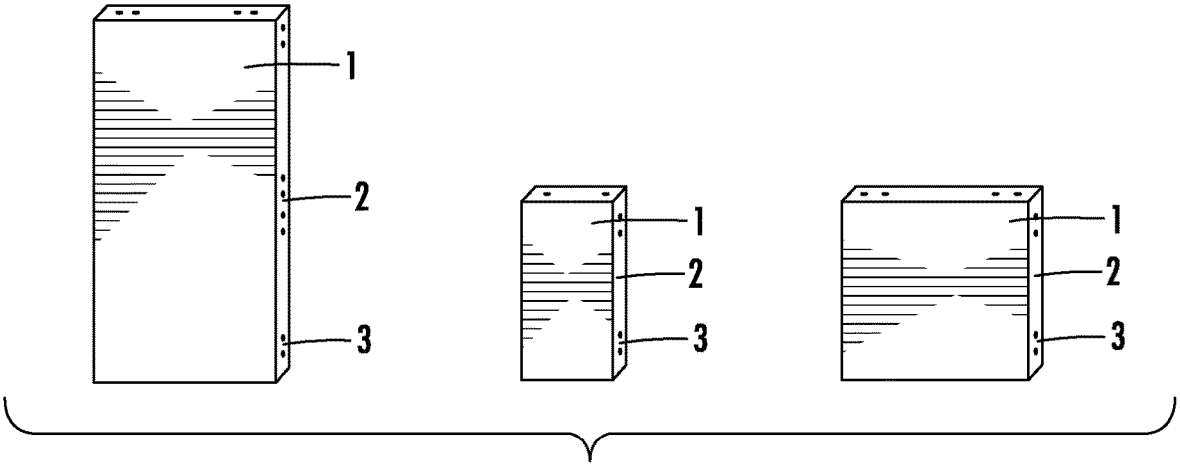
FIG. 1 represents a frontal view of a "main" panel and its pivoted wrap edges with through-holes for bolting between panels.
Figure 2:
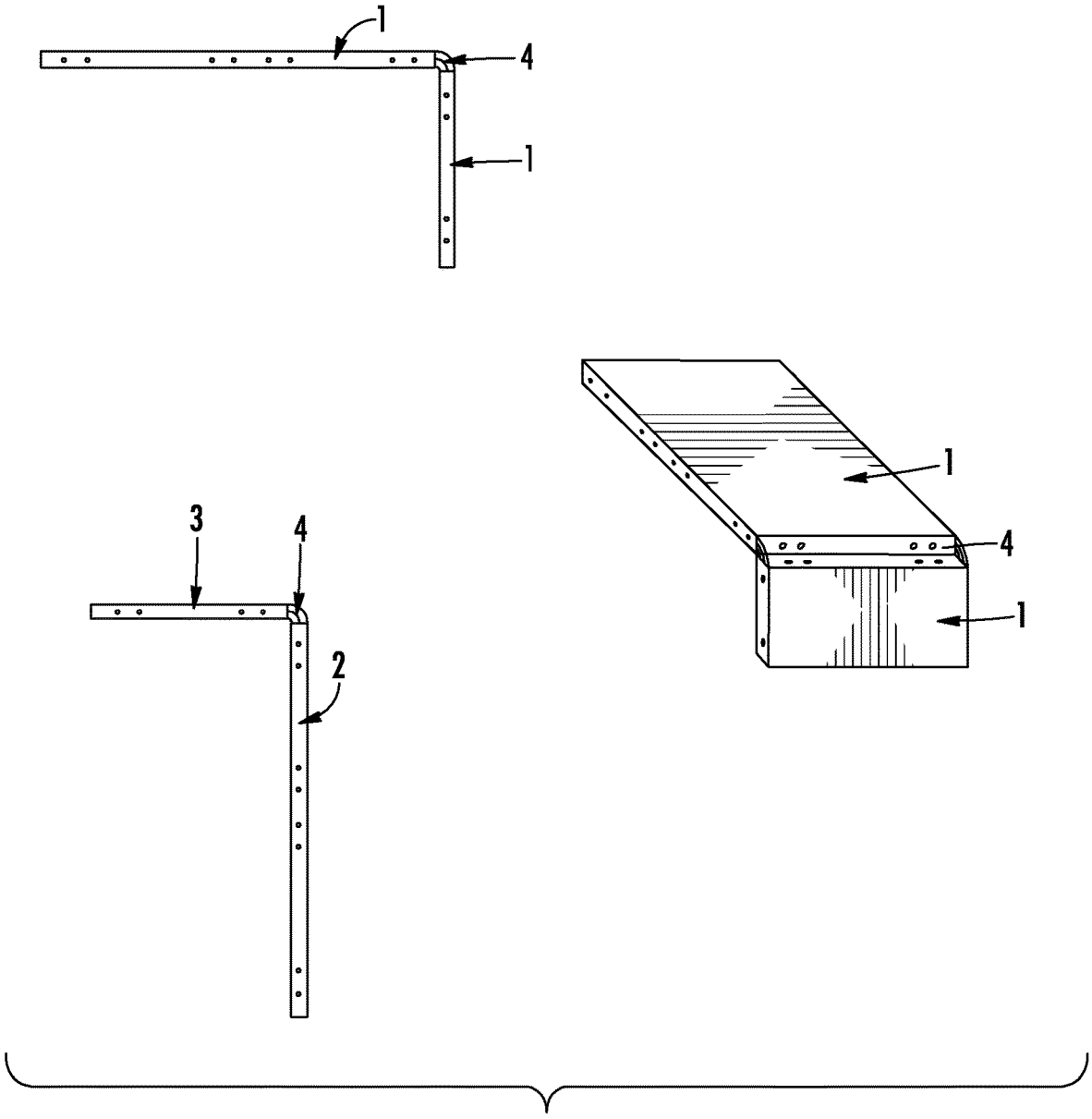
FIG. 2 represents a side view in perspective of the interconnection between main panels, using "angled" panels.
Figure 3:
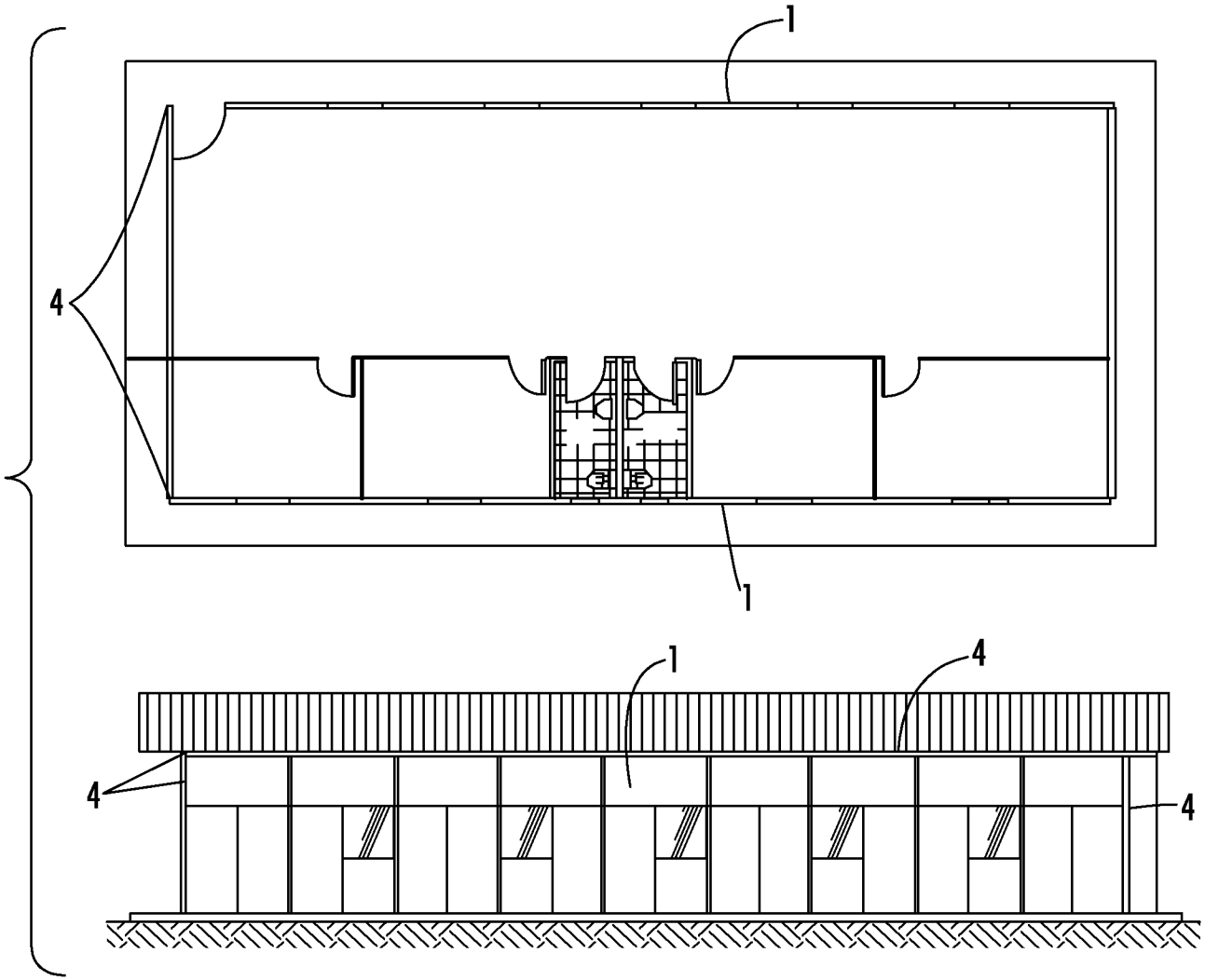
FIG. 3 represents the blueprint and the view of the façade of structures built through the joining of the above-mentioned panels, including the junction of the "main" panels and "angled" panels.
Figure 4:
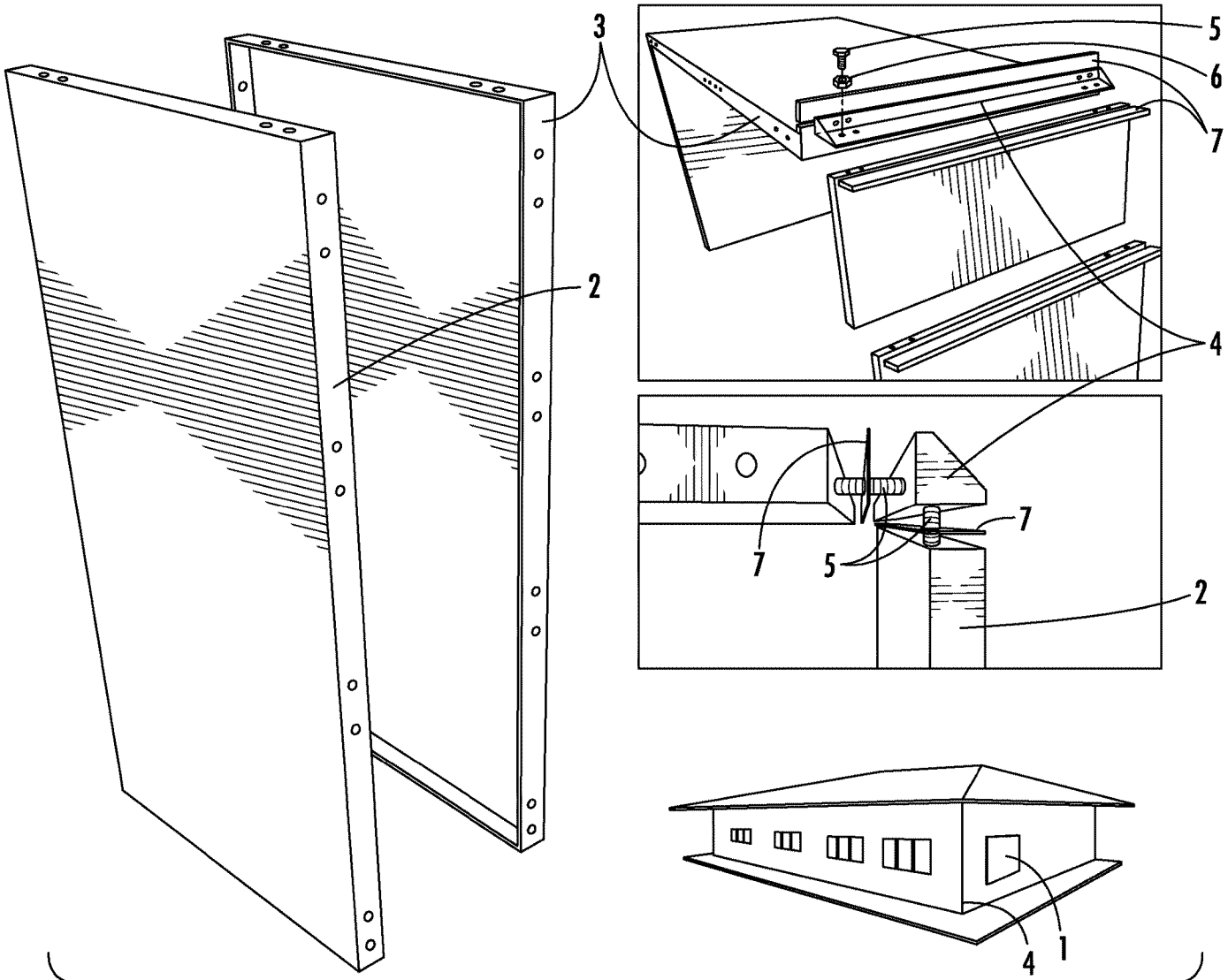
FIG. 4 represents the "main" panels and "angled" panels in three dimensions, their structures of interconnection and structures assembled through the joining of the above-mentioned panels.

Using the attached images as a reference point, this utility model consists of modular SMC (Sheet Molding Compound) panels (1), usually rectangular, manufactured in previously defined sizes, containing pivoted wrap edges (2) with regularly distributed through-holes (3), which allow for a simple and hermetic interconnection of panels through screws (5), nuts (6) and sealants (7). The series of panels are interfixed to each other through "angled" panels (4) and a system of bolting (5, 6) and sealing (7) between perpendicular panels, which result in the formation of constructive structures. The assembly is simple and fast, since the SMC is an extremely light and resistant material. In addition, the use of screws, nuts and sealants enables the assembly to be done by non-specialized professionals.

The invention claimed is:

1. A modular construction system comprising:

a series of main modular panels of sheet molding compound (SMC), each of the main modular panels including pivoted wrap edges around a perimeter thereof, a first portion and a second portion perpendicular to the first portion, each of the pivoted wrap edges including a plurality of main modular panel through-holes;

a plurality of angled panels interfixing respective adjacent first and second portions of main modular panels of the series of main modular panels, each of the plurality of angled panels having a first surface and a second surface perpendicular to the first surface, each of the first and second surfaces including a plurality of angled panel through-holes aligned with the main modular panel through-holes of the pivoted wrap edges of the respective adjacent one of the first and second portions of main modular panels of the series of main modular panels; and a plurality of bolts extending through the aligned angled panel through-holes and the main modular panel through-holes to secure the first and second surfaces of the angled panels to the pivoted wrap edges of the main modular panels; and a sealant located between the first and second surfaces of the angled panels and the pivoted wrap edges of the main modular panels thereby defining a hermetic connection between adjacent main modular panels of the series of main modular panels.

* * * * *